United States Patent [19]

Dorner

[11] 4,309,271

[45] Jan. 5, 1982

[54] METHOD FOR CRACKING HYDROCARBONS

[76] Inventor: Armin Dorner, Strasserberg 4e, 8023 Baierbrunn, Fed. Rep. of Germany

[21] Appl. No.: 77,823

[22] Filed: Sep. 21, 1979

[30] Foreign Application Priority Data

Sep. 21, 1978 [DE] Fed. Rep. of Germany ..... 2840987

[51] Int. Cl.[3] ..... C10G 9/36

[52] U.S. Cl. ..... 208/57; 208/89; 585/251; 585/315; 585/650

[58] Field of Search ..... 208/57, 58, 61, 86, 208/89, 100, 103, 309; 585/264, 315, 329-330, 648, 324, 650

[56] References Cited

U.S. PATENT DOCUMENTS

| | | | |
|---|---|---|---|
| 3,781,195 | 12/1973 | Davis et al. | 208/87 |
| 4,039,429 | 8/1977 | Klinken et al. | 208/50 |
| 4,115,246 | 9/1978 | Sweany | 208/56 |
| 4,115,467 | 9/1978 | Fowler | 585/324 |
| 4,180,453 | 12/1979 | Franck et al. | 208/57 |
| 4,188,281 | 2/1980 | Wernicke et al. | 208/57 |

*Primary Examiner*—Curtis R. Davis
*Assistant Examiner*—G. E. Schmitkons
*Attorney, Agent, or Firm*—James C. Wray

[57] ABSTRACT

Hydrocarbons are subjected to hydrogenation, pressure reduction and separation into liquid and gaseous fractions. The gaseous fractions are purified and desulfurized. Hydrogen-rich components of the gaseous fraction are returned to the hydrogenation stage. Hydrocarbon-rich components of the gaseous fraction and components of the liquid fraction are cracked and fractionated. Residue is partially oxidized with oxygen and steam. Gas produced by the partial oxidation is desulfurized and separated, and hydrogen is returned to the hydrogenation stage. A polymer free fraction of the residue is returned to the feed stock and to the hydrogenation stage, a heavy residue component of the initial liquid fraction is partially oxidized with the residue.

7 Claims, 2 Drawing Figures

METHOD FOR CRACKING HYDROCARBONS

The invention concerns a method for cracking hydrocarbons, where the hydrocarbons are first hydrogenated and subsequently thermally cracked.

In the production of olefins, light hydrocarbons like ethane or propane or hydrocarbon mixtures with a boiling point below 200° C., for example naphtha, are especially suitable feedstocks for thermal cracking. They lead to a high yield and yield few undesirable byproducts.

Since, however, there is a great need for olefins, which can lead to a shortage or price increase of these favorable feedstocks, the attempt has been made for some time to develop a method which also allows the favorable use of a high boiling feedstock.

The use of high boiling feedstocks basically involves the problem that the olefin yield declines and liquid byproducts are obtained, whose fraction greatly increases with increasing boiling range of the feedstock. The liquid byproducts are usually separated into a fraction boiling below 200° C. and a fraction boiling above 200° C. The lower boiling fraction represents a high octane fuel and contains valuable components such as benzene, toluene, and xylene. The fraction boiling above 200° C. on the other hand forms a undesirable product, which contains highly condensed aromatics, polymer compounds and sulfur compounds. The portion of this fraction, to be designated in the following as a residue, lies in the range of about 1 to 5 wt.% of the total products in the case of naphtha-cracking, increases to about 30 wt.% if gas oil is cracked and still heavier feedstocks like vacuum gas oil, crude oil or crude oil residues yield even higher values. The sulfur contained in the feedstock is enriched in the residue in such amounts that firing of only this fuel without mixing it with low sulfur fuels leads to an intolerable strongly polluting exhaust gas. However, the mixing with low sulfur fuels involves other problems, because the residue can be mixed only to a limited degree with crude oil distillates and therefore can be only partially diluted with them. A further undesirable property of this fraction is to be seen in the fact that it is only storable and transportable to a limited degree.

The production of olefins by cracking hydrocarbon mixtures with a boiling range above 200° C., like for example gas oil or vacuum gas oil, is not economically feasible, if no provisions are made to reduce the occurring amounts of residue or in case this fraction cannot be brought to another economical use.

To solve this problem, it is already known from German patent application No. 21 64 951 (laid open for public inspection) now issued as U.S. Pat. No. 3,781,195 to catalytically hydrogenate the feedstock in the presence of hydrogen before thermally cracking it. This hydrogenating pretreatment leads to a reduction in the content of polyaromatic compounds, which are responsible for the formation of the residue. In addition, desulfurization of the feedstock occurs. Although the amount of liquid cracking products boiling above 200° C. is reduced by this known method, compared to methods without previous hydrogenation, yet large amounts of residue are obtained due to the used high boiling feedstocks.

Moreover, it has already been proposed (German patent application No. 28 05 721 equivalent to Brit. Pat. No. 2,014,606), to process the cracking products boiling above 200° C. in such a way that the polymer components of this fraction, which make up about 20 wt.%, are separated. While the polymer-free fraction represents a valuable fuel oil, on the other hand the separated polymer residues represent a product that is hardly utilizable.

It is an object of the invention to provide an economical and efficient method of cracking heavy hydrocarbons. It is a further object of the invention to provide a method of cracking hydrocarbons wherein no products having a boiling range over that of benzine are obtained.

These and other objects of the invention that will be evident from the following are obtained in a method of cracking hydrocarbons in which the hydrocarbons are first hydrogenated and subsequently thermally cracked, the method further comprising the step of converting at least a part of the residue of the thermal cracking to a gas mixture by partial oxidation.

With the method according to the invention, a gas mixture consisting essentially of carbon monoxides and hydrogen is produced from the residue fraction, which—eventually after purification and/or decomposition into different individual components—is useable for a series of different processes for example as reduction gas, synthesis gas or fuel gas. Thus a widely useable and economically interesting gas mixture is produced from the low evaluated residue of thermal cracking.

The partial oxidation can be carried out with air, oxygen or with other gases enriched with oxygen. Moreover, it is favorable to add steam as an additional gasification medium.

In an additional further development of the method according to the invention, after its separation from the residue fraction, only the polymer components of this fraction are converted to a gas mixture. This results in an increasing economy of the overall method, since only a small amount of about 20% of the residue fraction enters the partial oxidation, which results in the reduction of equipment and furthermore leads to a reduced demand of oxygen-containing oxidation media and eventually steam. The polymer-free part of the residue fraction can be used either directly as fuel oil or may be recycled to the hydrogenation step.

In case the residue fractions freed from polymer compounds are again conducted into the hydrogenation stage, especially high yields can be achieved with respect to the desired products, because, in the hydrogenation and subsequent thermal cracking, the purified residue fraction yields similar products like fresh feedstock.

Hydrogen is needed for the reactions occurring in the hydrogenation stage. The hydrogen produced in the thermal cracking step may, after being separated from the other cracking products, directly be conducted to the hydrogenation step. But generally only about 10 to 30% of the hydrogen demand can be covered by this. Therefore, to satisfy the further demand of hydrogen, in a further development of the invention, a hydrogen-rich fraction is separated from the gas produced in the partial oxidation and conducted to the hydrogenation. With such a method, the hydrogen demand to be covered with external provision is especially small. Moreover, it is favorable that a part of the gas mixture be used again in the process so that no precautions are necessary for an export of gas to special separate installations. The residual gas occuring with the separation of the gas mixture can be used for example as heating gas.

Since hydrogenation is carried out generally with an excess of hydrogen, the hydrogenation products consist of a liquid fraction of hydrocarbons and a gaseous fraction containing essentially hydrogen. In addition, some light hydrocarbons and gaseous impurities like hydrogen sulfide are contained in the gaseous fraction. While the light hydrocarbons from the gaseous fraction represent a favorable feedstock for thermal cracking, the excess hydrogen, after its separation, is recycled to the hydrogenation step. This method requires a gas separation, in which hydrogen as well as impurities are separated from light hydrocarbons. Since the gas mixture obtained in the partial oxidation also must be subjected to separation, in order to separate off the hydrogen for hydrogenation, it is favorable in a further development of the method according to the invention to fractionate this gas mixture in common with the gaseous fraction occuring after hydrogenation, in order to reduce the costs for investment and operation of the plant.

In the following, the method according to the invention will be explained in more detail by two embodiments which are shown schematically in the figures. Both figures show a method in which a heavy hydrocarbon mixture is first hydrogenated and then thermally cracked. The heavy residues occurring with this method are converted by means of partial oxidation into a hydrogen rich gas, whereby the hydrogen is conducted to the hydrogenation stage after its purification.

Figure 1:
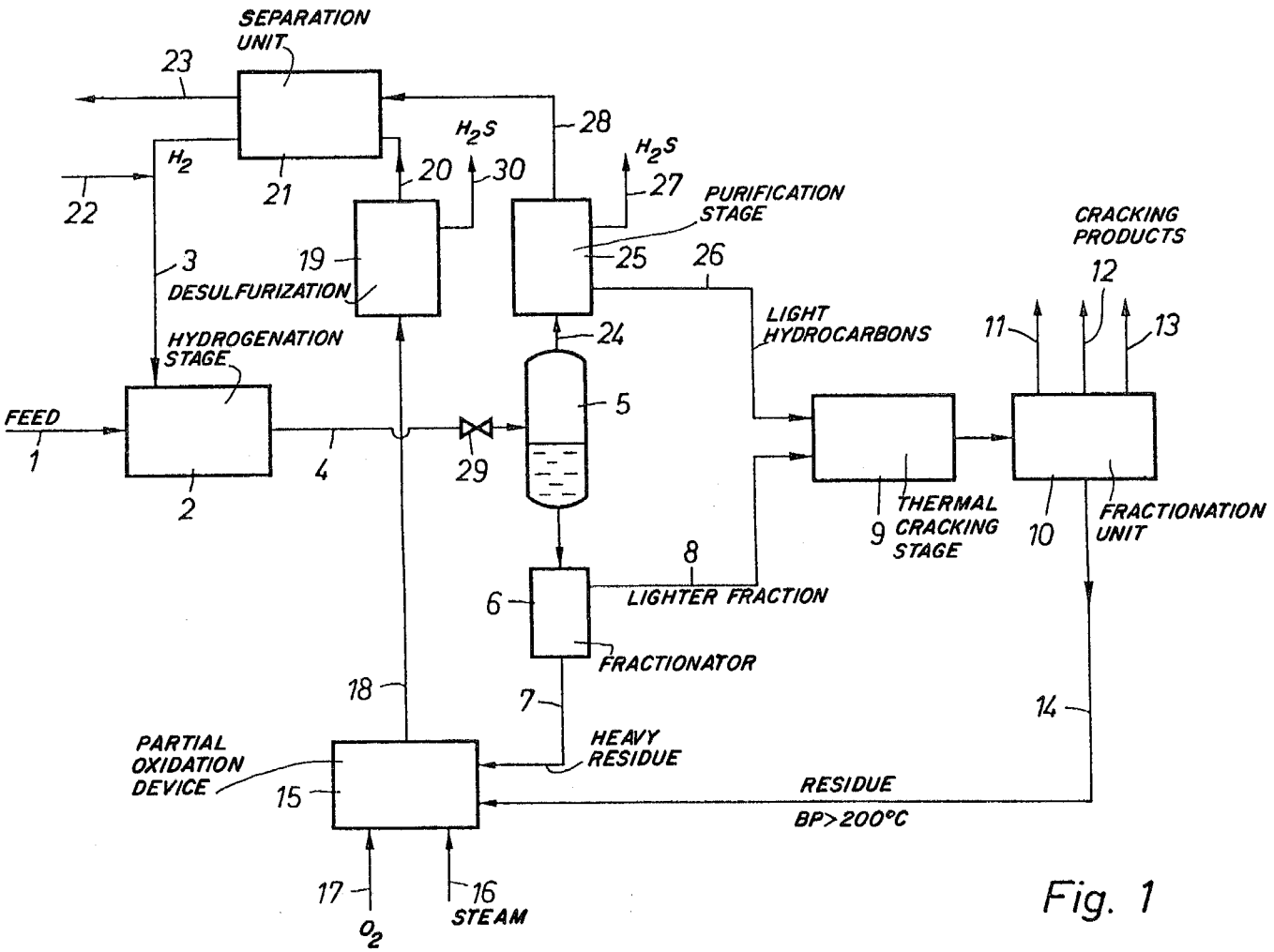
FIG. 1 shows a first embodiment of the invention.

The feedstock, for example a vacuum distillate, is conducted over line 1, to hydrogenation stage 2. The hydrogenation can be carried out with the use of conventional sulfur-resistant catalysts containing elements of the VI–VIIIth group of the periodic system or mixtures thereof in elementary, oxide or sulfide form on a carrier of silica, silica/alumina or a zeolite basis. Favorable hydrogenation conditions include pressures between 10 and 300 bar, preferably between 15 and 150 bar, temperatures between 100° and 500° C., preferably between 200° and 400° C. and space velocities between 0.2 and 10 liters per liter per hour.

The hydrogen required for the hydrogenation is conducted to hydrogenation step 2 via line 3. The hydrogenation product is drawn off through line 4 and its pressure is relieved to the pressure of thermal cracking in pressure relief valve 29, preferably to a pressure between 1 and 4 bar. Subsequently, the hydrogenation product flows into a separator 5 where it is separated into a gaseous fraction consisting essentially of hydrogen and a liquid hydrogenation product. The liquid fraction is drawn off to a fractionator 6, in which a heavy residue of hydrogenation product is separated off and drawn off over line 7, while a lighter fraction boiling in the benzine range is drawn off over line 8.

This latter fraction arrives in the thermal cracking stage 9 and there it is cracked into an olefin-rich gas mixture. Cracking is advantageously carried out in a tube furnace at temperatures between 700° and 1000° C., a period of dwell between 0.01 and 1 sec and a steam dilution of 0.2 to 4.0 kg steam per kg hydrocarbons. The hot cracked gas is subsequently quenched and conducted to a fractionation unit 10. Here, the individual cracking products are isolated and drawn off separately from each other, which is indicated by lines 11, 12, 13. The pyrolysis residue boiling above 200° C. is drawn off over line 14 and fed into a device 15.

In this device 15, the residues from lines 7 and 14 are converted to a hydrogen-rich gas mixture by means of partial oxidation. Steam over line 16 and air or oxygen over line 17 are fed to device 15 as gasification media.

The crude gas formed in the partial oxidation is drawn off through line 18. Essentially it consists of hydrogen and carbon monoxide, if oxygen is fed through line 17, or of hydrogen, carbon monoxide and nitrogen if air is used as gasification medium. In addition, the crude gas contains impurities, especially hydrogen sulfide. Therefore, the gas is subjected to desulfurization 19, the separated hydrogen sulfide being removed through line 30.

The desulfurized gas is subsequently conducted over line 20 to a separation unit 21, in which the hydrogen is separated off. The separation unit 21 may, for example, be a pressure-swing-adsorption installation working with molecular sieves. The separated off hydrogen is drawn off through line 3 and conducted back into hydrogenation stage 2. To cover the hydrogen demand for the hydrogenation, additional hydrogen may be fed through line 22. This additional hydrogen may at least partially originate from fractionation step 10. The residual gas consisting essentially of carbon monoxide or, in the case partial oxidation with air, consisting of carbon monoxide and nitrogen is conducted off through line 23.

The gaseous fraction separated in separator 5 consists essentially of excess hydrogen from hydrogenation 2 and in addition contains light hydrocarbons obtained in the hydrogenation, as well as impurities, especially hydrogen sulfide. This fraction is conducted through line 24 into a purification stage 25, in which the light hydrocarbons are separated off and conducted through line 26 to thermal cracking. In addition, in this purification step, hydrogen sulfide is separated off and conducted off through line 27. The purified gas is subsequently conducted into the purification stage 21 through line 28 and there is subjected to a further purification in common with the gas mixture conducted through line 20.

Figure 2:
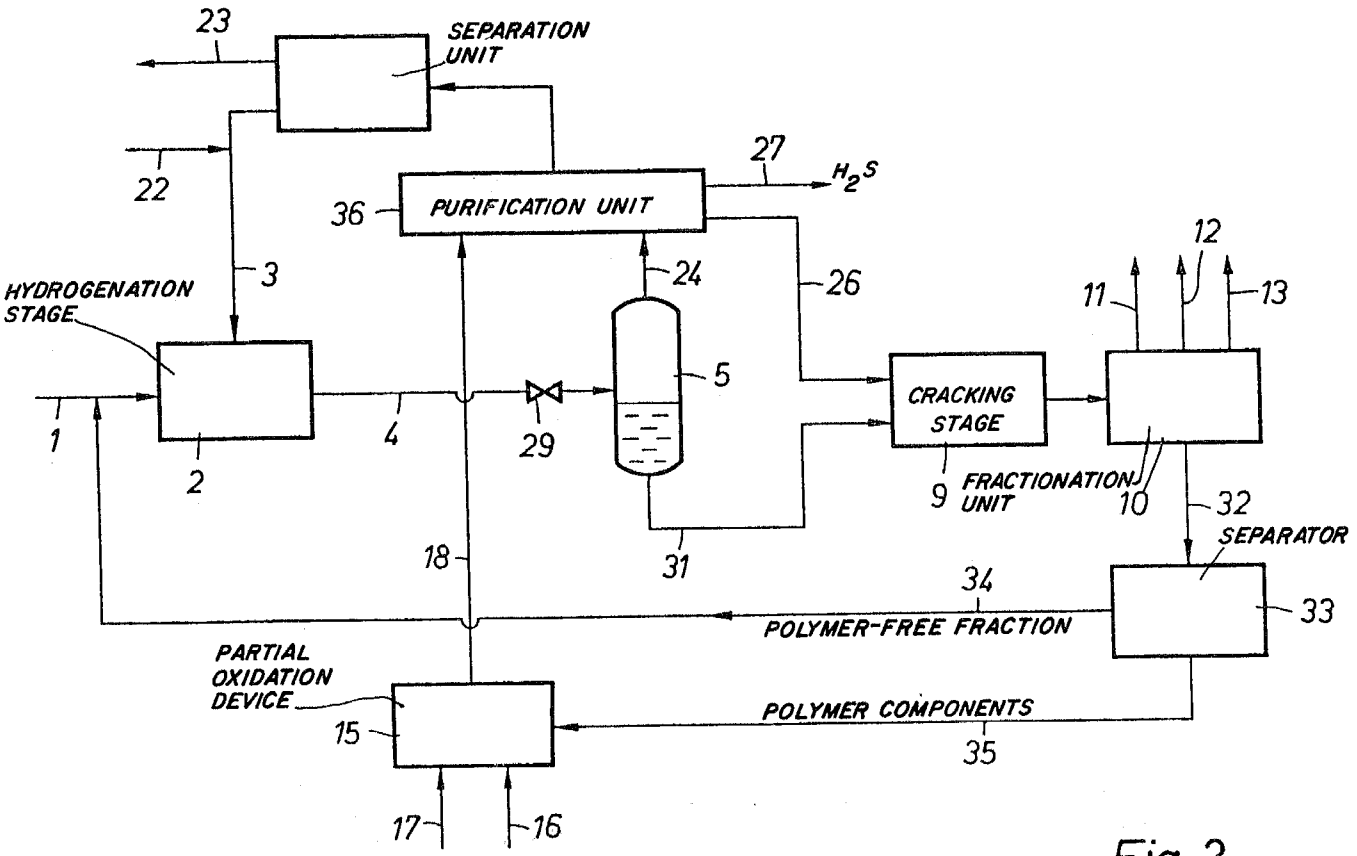
FIG. 2 shows a second embodiment of the invention.

The method shown in FIG. 2 differs from that of FIG. 1 in three points.

The first difference consists in the fact that the liquid hydrogenation product from separator 5 is conducted completely into thermal cracking 9 through line 31.

The second difference from the method of FIG. 1 consists in the fact that the residue fraction boiling above 200° C. and obtained in the fractionation unit 10 is not completely conducted to partial oxidation. Instead of this, this fraction drawn off through line 32 is fed into a treatment unit 33, in which the polymer components of the fraction are separated off, for example by solvent extraction. The polymer-free fraction is drawn off through line 34 and is conducted back to hydrogenation 2, where it is mixed with fresh feedstock. The polymer components from the heavy fraction are drawn off through line 35 and conducted to partial oxidation 15.

The third difference from the method of FIG. 1 consists in the common processing of the gas obtained by partial oxidation and of the gaseous fraction from the separator 5 in a purification unit 36.

It is not necessary that all three shown differences be carried out at the same time. Rather, it is also possible to realize each of these differences in themselves or in any combination. The actually preferred method is determined by the preconditions given in each special case, which can depend not only on the selection of the feedstock, but also on the desired method products and on external operational-technical preconditions.

What is claimed is:

1. In a method for cracking hydrocarbons, in which the hydrocarbons are first hydrogenated and subsequently are thermally cracked, the improvement comprising converting at least a part of the residue of the thermal cracking to a gas mixture by partial oxidation, desulfurizing and separating a hydrogen-rich fraction from the gas mixture and conducting the hydrogen-rich fraction to the hydrogentation step.

2. Method according to claim 1, in which the partial oxidation is carried out in the presence of steam.

3. Method according to claim 2, further comprising a separation of the polymer components of the residue of thermal cracking, wherein the converting comprises converting the polymer components to a gas mixture, and further recycling the remaining components of the residue of thermal cracking to the hydrogenation.

4. Method according to claim 1, further comprising the steps of separating the hydrogenation product into a liquid and a gaseous fraction; separating the gaseous fraction into a hydrogen-rich and a hydrocarbon-rich fraction; conducting the hydrogen-rich fraction to the hydrogenation and the hydrocarbon-rich fraction to thermal cracking; separating the liquid fraction into a lighter fraction and a heavy residue, conducting the lighter fraction to thermal cracking, and conducting the heavy residue to the partial oxidation step and partially oxidating the heavy residue with residue of the thermal cracking.

5. Method according to claim 1, further comprising the step of separating the hydrogenation product into a liquid and a gaseous fraction; separating the gaseous fraction into a hydrogen-rich and a hydrocarbon-rich fraction; conducting the hydrogen-rich fraction to the hydrogenation and the hydrocarbon-rich fraction to thermal cracking; and purifying the gas mixture and the gaseous fraction of the hydrogenation product in one combined step.

6. Method according to claim 5 wherein the purifying comprises desulfurizing the gas mixture and the gaseous fraction in one combined step.

7. Method according to claim 5 wherein the purifying comprises separating a hydrogen-rich fraction from the gaseous mixture and from the gaseous fraction in one combined step.

* * * * *